US011156028B1

(12) United States Patent
Moeller

(10) Patent No.: US 11,156,028 B1
(45) Date of Patent: Oct. 26, 2021

(54) BARN DOOR HARDWARE CONVERSION SYSTEM

(71) Applicant: David W. Moeller, Flowery Branch, GA (US)

(72) Inventor: David W. Moeller, Flowery Branch, GA (US)

( * ) Notice: Subject to any disclaimer, the term of this patent is extended or adjusted under 35 U.S.C. 154(b) by 29 days.

(21) Appl. No.: 15/999,925

(22) Filed: Sep. 1, 2018

Related U.S. Application Data

(60) Provisional application No. 62/606,009, filed on Sep. 2, 2017.

(51) Int. Cl.

| | |
|---|---|
| ***E05D 13/00*** | (2006.01) |
| ***E06B 3/46*** | (2006.01) |
| ***E05B 65/08*** | (2006.01) |
| ***E05D 15/06*** | (2006.01) |

(52) U.S. Cl.
CPC ..... *E06B 3/4636* (2013.01); *E05B 65/08* (2013.01); *E05D 15/063* (2013.01); *E05D 15/0652* (2013.01); *E05D 15/0656* (2013.01); *E05Y 2201/224* (2013.01); *E05Y 2600/51* (2013.01); *E05Y 2900/132* (2013.01)

(58) Field of Classification Search
CPC . E05D 15/0652; E05D 15/063; E06B 3/4636; E06B 3/4645; E05Y 2900/132; E05Y 2600/60; E05Y 2600/10; E05Y 2600/634; Y10T 29/4984; Y10T 16/379; Y10T 16/381
USPC .... 49/410, 425, 506, 404, 504; 16/96 R, 97, 16/106, 107; 29/434
See application file for complete search history.

(56) References Cited

U.S. PATENT DOCUMENTS

| | | | | | |
|---|---|---|---|---|---|
| 920,083 | A | | 4/1909 | Pitcher | |
| 1,985,298 | A | * | 12/1934 | Prince | E05D 15/0656 16/93 R |
| 2,610,367 | A | | 9/1952 | Nordahl | |
| 2,784,444 | A | * | 3/1957 | Greig | E05D 15/0652 16/87 R |
| 2,784,445 | A | | 3/1957 | Greig | |
| 3,261,129 | A | | 7/1966 | Brydolf | |
| 3,555,750 | A | | 1/1971 | Banse | |
| 3,611,637 | A | * | 10/1971 | Saino | E05D 15/1021 49/235 |
| 3,744,827 | A | | 7/1973 | Cox | |
| 3,854,165 | A | * | 12/1974 | Haley | E06B 3/4663 16/96 R |
| 3,925,933 | A | * | 12/1975 | Reuter | E05D 15/0639 49/409 |
| 4,104,829 | A | * | 8/1978 | Agcaoili | E05D 15/0634 16/105 |
| 4,193,500 | A | | 3/1980 | Scott | |
| 4,513,554 | A | * | 4/1985 | Johnson | E06B 3/4636 403/205 |
| 4,680,828 | A | | 7/1987 | Cook | |
| 6,209,171 | B1 | | 4/2001 | Pelletier | |
| 6,289,643 | B1 | * | 9/2001 | Bonar | E06B 3/4654 49/505 |

(Continued)

*Primary Examiner* — Chi Q Nguyen
(74) *Attorney, Agent, or Firm* — James K. Poole, Esq.

(57) ABSTRACT

A barn door hardware conversion system that allows for an existing hinge mounted door to be converted to a barn door style sliding door. The hardware system primarily mounts to the existing frame components of the door opening, eliminating the need to secure components to the existing wall surface above the door opening.

14 Claims, 11 Drawing Sheets

(56) References Cited

U.S. PATENT DOCUMENTS

| | | | | |
|---|---|---|---|---|
| 6,470,652 | B1 * | 10/2002 | Piron | B65B 31/04 53/511 |
| 9,091,106 | B2 * | 7/2015 | Allen | E05D 15/0652 |
| 10,538,947 | B2 * | 1/2020 | Boring | E05D 15/0626 |
| 10,619,392 | B2 * | 4/2020 | Hyunh | E05D 15/063 |
| 10,947,762 | B2 * | 3/2021 | Summers | E05D 15/48 |
| 2004/0003556 | A1 * | 1/2004 | Zerbst | E05D 15/0643 52/220.7 |
| 2011/0311035 | A1 * | 12/2011 | Schiffler | H04M 15/00 379/114.13 |
| 2014/0250633 | A1 * | 9/2014 | Allen | E05D 15/0652 16/96 R |
| 2014/0311035 | A1 | 10/2014 | Gilliam | |
| 2016/0265258 | A1 * | 9/2016 | Bouthillier | E05D 15/0652 |
| 2016/0287027 | A1 * | 10/2016 | Hayes | E05D 15/0621 |
| 2018/0023336 | A1 * | 1/2018 | Groff | E06B 3/4636 49/410 |

* cited by examiner 30
31
33
34
36
38

30
34
31
32
36
38

30
31
34
36

91
90
92

95
94
95

99
98
97
96

99
96
98

100
100
100
102
102
104

BARN DOOR HARDWARE CONVERSION SYSTEM

CROSS-REFERENCE TO RELATED APPLICATIONS

This application claims the benefit of Applicant's provisional application U.S. Ser. No. 62/606,009 for "BARN DOOR HARDWARE CONVERSION SYSTEM," FILED Sep. 2, 2017.

This application is not a result of federally sponsored research or development.

BACKGROUND OF THE INVENTION

1. Field of the Invention

The present invention relates to a door hanging hardware system that allows for easy conversion of an existing hinge mounted interior door into a barn door style sliding interior door or for the hanging of a new barn style door.

2. Description of Relevant Art

Doors and hardware systems to hang doors have been in use for hundreds of years. Doors are typically hung using hinges that attach between one vertical door edge (the edge of the door's stile) and one vertical edge of the frame around the door opening to allow the door to swing open and closed. In addition to hinges, doors have also been suspended from rollers riding in and/or on shaped tracks that are fixed to the structure of the house. These types of sliding door installations fall into three primary categories; "pocket" style doors where the full width of the door slides into a recess inside the adjacent wall, bypass style doors where two half width doors overlap and slide individually on parallel tracks, and barn style doors where the full width door slides in front of the wall adjacent to the door opening.

Patents such as Pitcher's U.S. Pat. No. 920,083, Nordahl's U.S. Pat. No. 2,610,367 and others describe door hanging systems that use a track that is secured to the house structure above the door and inside the adjacent wall that allow for the door to be laterally carried on door mounted rollers into recesses in the walls. While these pocket style door systems allow for the safe hanging of a sliding door, they require that a space large enough to hold the door be present in the adjacent wall to contain the door when it is open. As a result, this type of system would require extensive remodeling of the adjacent wall structure to create the needed space for an existing hinge mounted door to be converted into a pocket style door.

Patents such as Greig, et.al. U.S. Pat. No. 2,784,445, Brydolf, et.al. U.S. Pat. No. 3,261,129, Cox's U.S. Pat. No. 3,744,827, Scott's U.S. Pat. No. 4,193,500, Pelletier et.al. U.S. Pat. No. 6,209,171 and others describe systems that use parallel tracks mounted on the bottom face of the upper horizontal part of the door opening (into the header of the door frame) and door mounted rollers. This system limits the sliding of the door to within the confines of the door opening so the original door would have to be replaced, typically with two doors that have a total width that is slightly wider than the opening so the edges of the doors can overlap to form a closed door. As such, the conversion of a hinge mounted door to a bypass style door would require replacement of the door and reduce the passable size of the opening.

Patents and applications such as Banse's U.S. Pat. No. 3,555,750, Cook et.al., U.S. Pat. No. 4,680,828, Allen et.al., U.S. Pat. No. 9,091,106, Gillam's US 2014/0311035 and others describe door hanging systems that use a track which is secured to the wall structure both above the door along the wall adjacent to the door opening that allows for the door to be laterally slid on door mounted rollers to a location in front of the wall and beside the door opening. While these barn style door systems allow for the safe hanging of a sliding door, they require that the track be secured to the face of the wall in multiple locations. The need for multiple mount points can be a problem if the locations of studs in the wall do not align with the preset track mounting locations, if the wall surface is made from brick, masonry, or other type of surface that is difficult to drill and mount hardware on, or is a wall surface that the user does not want to damage.

In view of the foregoing disadvantages and limitations found in the prior art of producing barn-style sliding doors, there is need for a barn door hardware conversion system.

SUMMARY

A barn door conversion hardware system includes a set of individual components that allow a user to convert a hinge mounted interior door that is present in an existing structure and rehang it as a sliding barn style door with a minimum of complexity and effort.

The components of this system are as follows:

- Two door carriers, each including a shaped roller wheel mounted to a rigid hanger. Each door carrier is secured to the top edge or face of the door using mechanical fasteners. The door carriers should have sufficient structural strength to hold the weight of the door after it has been fastened to them and sufficient rigidity to hold the roller wheels vertically without deflection, both including periods when the installed door is in motion.
- A shaped suspension rail that has a length greater than twice the width of the existing door opening, has a top edge profile designed to mate with the door carrier roller wheel profile and has sufficient structural strength to support the weight of the door and door carriers.
- Two door frame mounts that are shaped to be securely mounted into the upper inside corners of the existing door opening (where each door jamb leg meets the header). The door frame mounts are each secured in place using mechanical fasteners and are designed to accept and have sufficient structural strength to securely hold the primary rail carriers, rail, door carriers and the door.
- Two primary rail carriers that are shaped to fit into and be secured to the door frame mounts. Once mounted to the door frame mounts, one end of the shaped suspension rail is then secured to one primary rail carrier and the approximate midpoint of the rail then mounts on the second primary rail carrier. The primary rail carriers are designed to hold the rail and have sufficient structural strength to securely hold the rail, door carriers and the door.
- One secondary rail carrier that includes either a shaped piece that mounts to the wall with mechanical fasteners and connects to the other end of the shaped suspension rail to support the rail or, alternatively, a floor supported system that consists of a shaped piece that connects to the end of the shaped rail, a shaped base piece that rests on the floor below the end of the shaped rail and a support bar that vertically connects between them and supports the end of the shaped rail. Both types of secondary rail carriers should have sufficient structural strength to securely hold the shaped rail, door carriers and door.

Two end stops that are shaped to securely mount to the ends of the shaped suspension rail and prevent the roller wheels of the door carriers traveling past the end of the shaped rail.

A set of mechanical or threaded fasteners designed to securely connect the various pieces into a rigid and secure structure that has sufficient structural strength to securely support the door.

The components of the above system can be cast, stamped, formed, molded, machined or otherwise fabricated from metals or other materials that have sufficient structural strength to securely support the loads placed on them.

Thus, one embodiment comprises two door carriers, each comprising a roller wheel having a concave exterior profile and mounted to a rigid hanger, the door carriers being designed and adapted for mechanical mounting to the top edge or face of the door to be converted and to suspend the door in place when so mounted; a shaped suspension rail having a length greater than twice the width of the door and a convex profile on the top surface thereof designed to mate with the concave profiles of the roller wheels of the door carriers; two door frame mounts adapted to be mounted inside the two upper corners of the door opening and to hold the primary rail carriers and bear the weight of the rail, door carriers and the door itself; two primary rail carriers adapted to be mechanically mounted on the door frame mounts to suspend the rail in place; a secondary rail carrier designed and adapted to be mechanically mounted to the wall and positioned to support the shaped rail, plus two end stops adapted to be securely mounted to the ends of the shaped rail to prevent the roller wheels of the door carriers from traveling beyond the end of the shaped rail.

In a second embodiment, in place of the secondary rail carrier described above, a floor supported system is provided which comprises a secondary rail attachment adapted to connect to the end of the shaped rail, a support foot designed to rest on the floor below the secondary rail attachment and the end of the shaped rail and a vertical support rod which extends between and is mechanically connected to the secondary rail attachment and the support foot pieces so as to support the end of the shaped rail, as illustrated in FIG. 2 herein.

Processes of converting a conventional hinged door to a sliding "barn door" style door comprise steps of:

Removing the door from the doorway, removing all hinges, related hardware and any lockset or door knobs;

mechanically attaching two door carriers to the top of the door;

mechanically attaching two door frame mounts in the upper corners of the door frame;

inserting and mechanically attaching the two primary rail carriers into the two door frame mounts;

attaching the secondary rail carrier to the wall surface to one side of the doorway in a position designed to support one end of the shaped rail;

installing the shaped rail above the doorway, suspended by the primary and secondary rail carriers;

mechanically attaching two end stops to the ends of the shaped rail, adapted to prevent the roller wheels of the door carriers from traveling beyond either end of the shaped rail;

placing the door in position and engaging the concave profiles of the roller wheels with the shaped rail to slidably suspend the door in position; and adjusting the components as necessary to enable free sliding of the door from full open to full closed positions.

The process for installing the second embodiment with a vertical support system include steps of:

in place of the secondary rail carriers above, attaching the secondary rail attachment to one end of the shaped rail;

positioning a support foot on the floor below the same end of the shaped rail; and installing the support rod between the support foot and the secondary rail attachment attached to the shaped rail to support the shaped rail in place; and then, installing the door with door carriers in place onto the shaped rail and adjusting to ensure proper operation.

The above system allows for an existing door to be converted from a standard hinge mount to a barn door style slide mounted door. The resulting slide mounted door does not require the modification of the adjacent walls as a pocket style door system would. The above system allows for the existing door to be reused, which is not an option for the sliding door systems which create a bypass door. Finally, the above system allows the slide to be secured with either no or very limited damage to the existing wall which is required with the current barn door style slide systems. The ease of conversion is facilitated by having the hardware system primarily secured to the existing door frame structure so the need for reliance on wall anchors to support the weight of the door is eliminated or minimized.

Alternatively, a plain "barn style" door, preferably oversized or larger than the door opening, can be fitted with the requisite hardware and installed in place of a conventional hinged door which has been removed, or to cover a doorway which lacks a door. The hardware components are installed as discussed above and the barn style door installed in the same manner as a hinged door which has been removed.

As a result the known deficiencies of the current sliding door hardware systems are addressed and overcome.

BRIEF DESCRIPTION OF THE DRAWINGS

The invention will be better understood and aspects other than those set forth above will become apparent when consideration is given to the following detailed description, the appended claims and drawings. The same numerals are used to designate like components in these figures. Such description makes reference to the annexed drawing wherein:

DETAILED DESCRIPTION OF PREFERRED EMBODIMENTS

In general, the following description adopts a terrestrial frame of reference, in which the bottom of a component is considered to be the side nearest the floor or earth when in normal use, and the top being the side opposite and facing upward. Similarly, a rectangular object, space or opening conventionally is described as having two sides, two ends and four corners. The term "and/or" is used in the conventional sense, in which "A and/or B" indicates that A or B, or both, may be present. A variety of typical mechanical fasteners can be used to assemble the components of the system embodiments described below, including without limitation nails, staples of various types, machine screws and bolts, wood and sheet metal screws, dowels and pins of various sorts, including cotter pins. Persons skilled in the art will be well prepared to use the mechanical fasteners provided with the component kits or to provide or substitute fasteners of their own choices.

Figure 1:
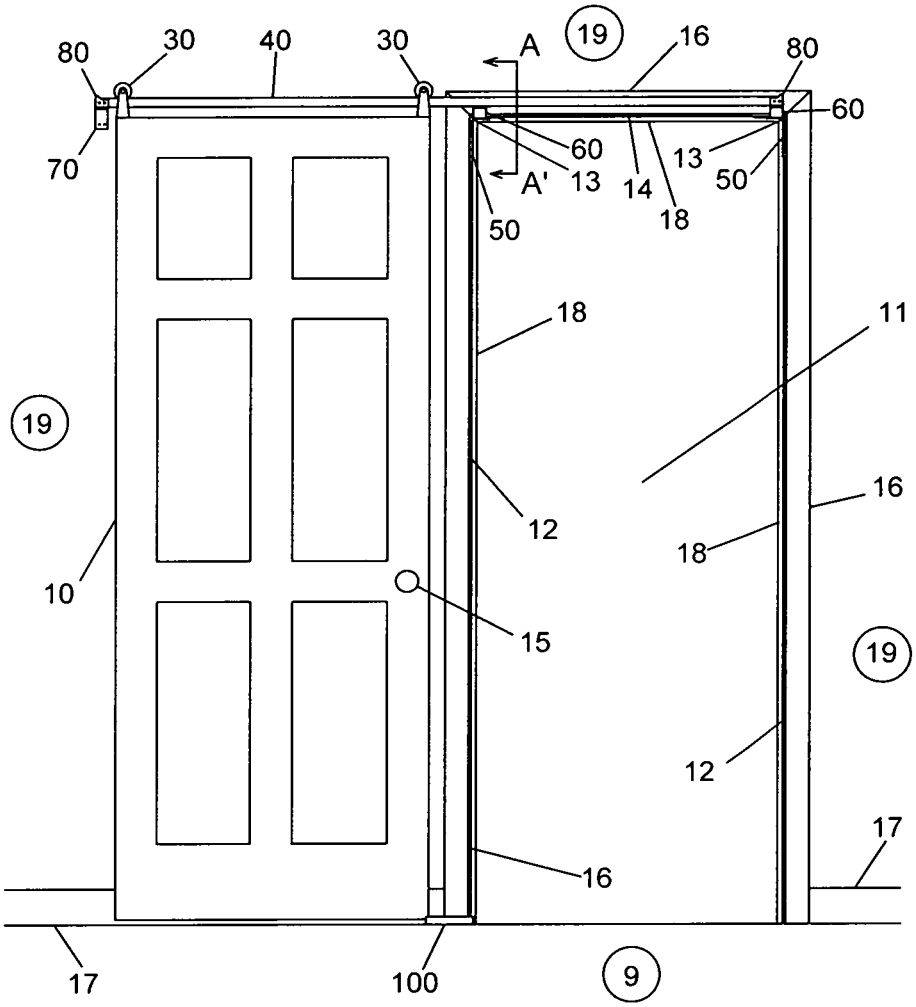
FIG. 1 is a front view of an existing hinge mounted door that has been rehung using the described hardware system with a wall mounted secondary rail carrier.

With reference to FIG. 1, an existing hinged door (10) that has been taken off its original hinge mounts and has had the lockset (not shown here) removed, leaving the lockset hole (15) in the door (10) and the existing door opening (11) the door (10) was mounted in are shown. The door opening (11) is defined by a door frame that includes two vertical door frame legs (12) and a horizontal door frame header (14) at the top. Pieces of door stop (18) are present on the faces of both door frame legs (12) and door frame header (14) as they were previously installed to allow for the hinged closure of the existing door (10) to function properly. The existing finished opening (11) has been previously trimmed with casing (16) that is decorative and hides any gaps between the door frame pieces (12 & 14) and the adjacent wall (19) surface. The transition from the wall (19) to the floor (9) has been previously covered by the decorative baseboard (17). The two door frame mounts (50) are shown secured using fasteners (not shown) to the upper corners (13) where the frame legs (12) meet the frame header (14). Two primary rail carriers (60) are inserted and secured using fasteners (not shown) into the door frame mounts (50). One end of a shaped suspension rail (40) is in turn secured to and supported by one of the primary rail carriers (60) using fasteners (not shown) and a second primary rail carrier (60) is inserted into roughly the midpoint of the shaped suspension rail (40). A secondary rail carrier (70) is mounted to the wall using fasteners (not shown) and secured using fasteners (not shown) to the opposite end of the shaped suspension rail (40). The existing door (10) has two door carriers (30) secured to the opposite corners of the top edge of the existing door (10) using fasteners (not shown). An end stop (80) is secured at each end of the shaped suspension rail (40) using fasteners (not shown) to prevent the over travel of the door (10) on the shaped suspension rail (40). At the bottom corner of the door (10) a door guide (100) secured to the floor (9) with fasteners (not shown) is shown. The door guide (100) keeps the door (10) from being pushed towards or pulled away from the wall (19). The lockset opening (15) in the door (10) that remains after removal of the lockset can be filled with either a commercially available recessed finger pull or a single sided door knob (not shown) to provide for gripping and sliding the door (10) open or closed. It should be noted that if the secondary rail carrier (70), when mounted to the opposite end of the shaped rail (40), will not be in alignment with the existing stud in the existing wall (19) that the secondary rail carrier (70) can be moved horizontally towards the door opening (11) the distance required to be aligned with and mechanically fastened to the stud (not shown) inside the existing wall (19). The shaped suspension rail (40) then will sit on the secondary rail carrier (70) with the secondary rail carrier (70) located between the end of the shaped rail (40) and the edge of the door opening (11).

Figure 2:
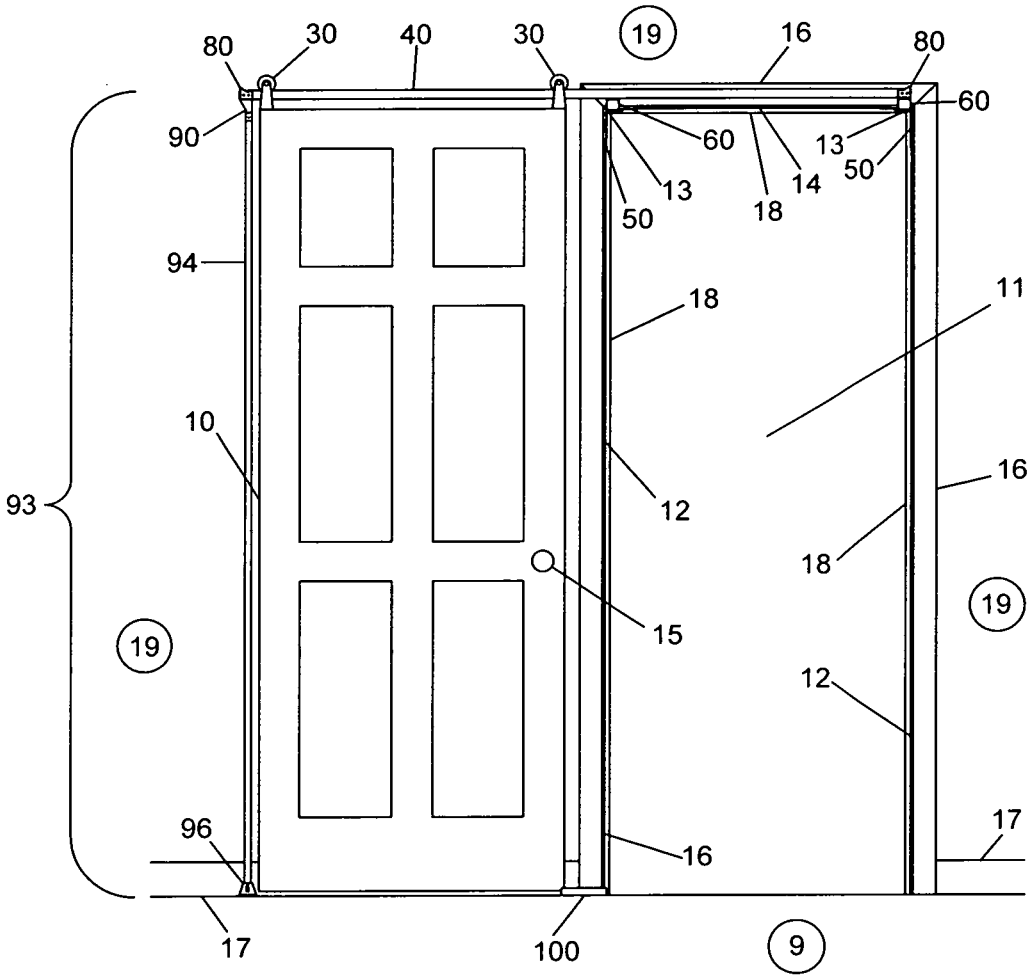
FIG. 2 is a front view of an existing hinge mounted door that has been rehung using the described hardware system with a floor supported secondary rail carrier.

With reference to FIG. 2, an existing door (10) that has been taken off its original hinge mounts and its lockset (not shown here) removed, leaving lockset hole (15) and its associated existing finished opening (11) are shown. The door opening (11) is defined by a door frame that includes two vertical door frame legs (12) and a horizontal door frame header (14) at the top. Pieces of door stop (18) are present on the faces of both door frame legs (12) and door frame header (14) as they were previously installed to allow for the hinged closure of the existing door (10) to function properly. The existing finished opening (11) has been previously trimmed with casing (16) that is decorative and hides any gaps between the door frame pieces (12 & 14) and the adjacent wall (19) surfaces. The transition from the wall (19) to the floor (9) has been previously covered by the decorative baseboard (17). Two door frame mounts (50) are shown secured using fasteners (not shown) to the corners (13) where the door frame legs (12) meet the door frame header (14). Two primary rail carriers (60) are inserted and secured using fasteners (not shown) to the door frame mounts (50). One end of the shaped suspension rail (40) is in turn secured using fasteners (not shown) to one of the primary rail carriers (60) and the second primary rail carrier (60) is inserted into roughly the midpoint of the shaped suspension rail (40). In this second embodiment, the secondary rail support attachment (90), vertical support rod (94) and support foot (96), which together comprise the floor supported secondary rail carrier (93), are secured using fasteners (not shown) to the opposite end of the shaped suspension rail (40) at the top end and rests on the existing floor (9) at the bottom end. The existing door (10) has two door carriers (30) secured to the opposite corners of the top edge of the existing door (10) using fasteners (not shown). An end stop (80) is secured using fasteners (not shown) at each end of the shaped suspension rail (40) to prevent the over travel of the door (10) on the shaped rail (40). At the bottom corner of the door (10) a door guide (100) secured to the floor (9) with fasteners (not shown) is shown. The door guide (100) keeps the door (10) from being pushed towards or pull away from the wall (19). The lockset opening (15) in the door (10) that remains after removal of the lockset can be filled with either a commercially available recessed finger pull or a single sided door knob (not shown) to provide for gripping and sliding the door (10) open or closed.

Figure 3:
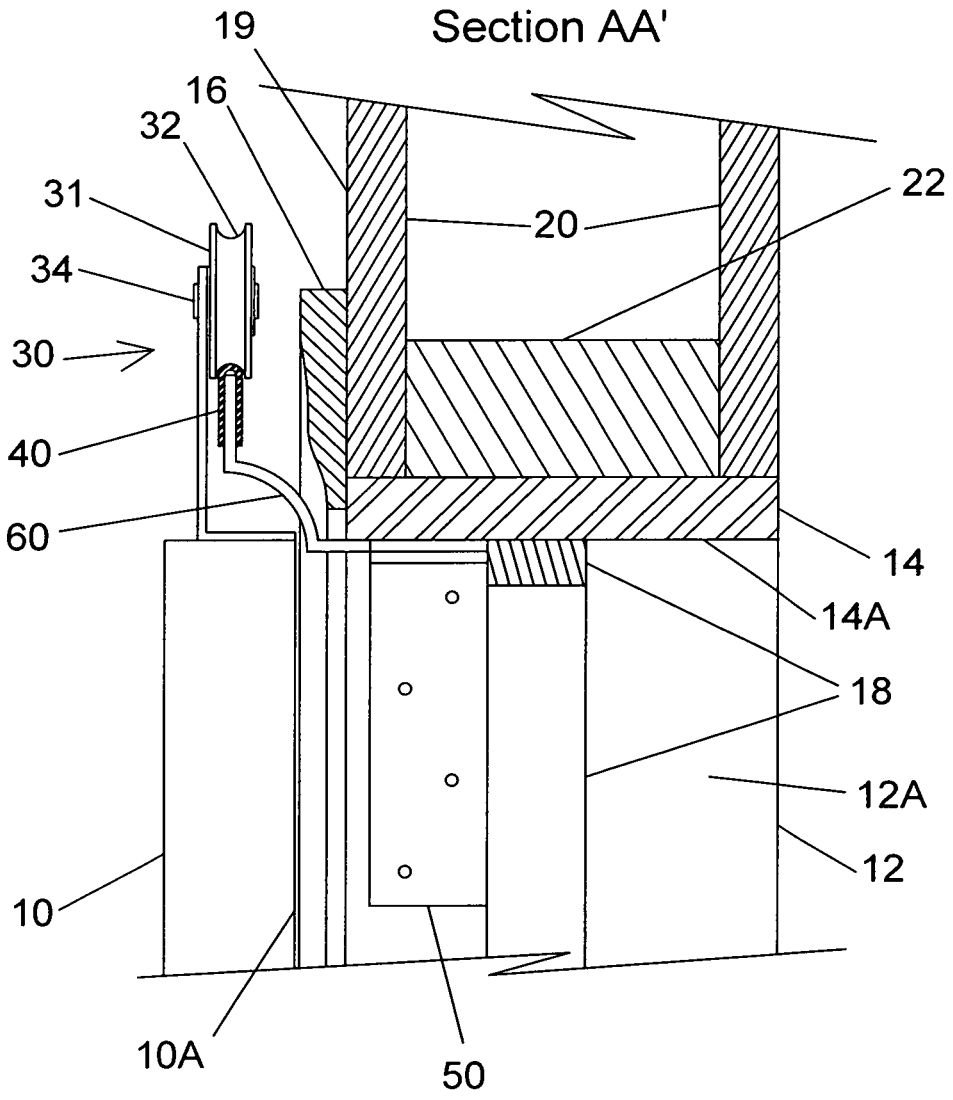
FIG. 3 is a cross sectional view AA' from FIG. 1 that details the door frame mount, primary rail carrier, shaped suspension rail, door carrier and other parts of the door and door opening.

FIG. 3 shows the cross section identified as AA' from FIG. 1. The basic construction of a typical frame wall construction is shown with the interior wood frame (22) covered on both faces with drywall (20) to form the wall (19). The existing frame leg (12) and existing frame header (14) are shown with the door stop (18) mounted to the face of the existing frame leg (12A) and the face of the existing framed header (14A). The previously installed casing (16) covers the transition from the frame leg (12) and header (14) to the wall (19) surface. The door frame mount (50) is shown secured to the face of the existing frame leg (12A) and face of the existing frame header (14A) using fasteners (not shown). The primary rail carrier (60) is secured to the door frame mount (50) using fasteners (not shown) and in turn is secured to and supports the shaped suspension rail (40) also using fasteners (not shown). The projection of the primary rail carrier (60) from the door frame mount (50) has been adjusted so that the travel path of the existing door (10) will allow for clearance between the back face of the existing door (10A) and the existing casing (16). The door carrier (30) is shown attached to the top edge of the existing door (10) using fasteners (not shown). The door carrier (30) is mounted to the top edge of the existing door (10) in a location that results in the centerline of the roller wheel (31) on the door carrier (30) being aligned with the midpoint of the door's thickness so that the existing door (10) will hang vertically and parallel to the face of the wall (19). The concave wheel edge profile (32) is shaped to ride securely on the convex upper face profile of the shaped suspension rail (40).

Figures 4A, 4B, 4C:
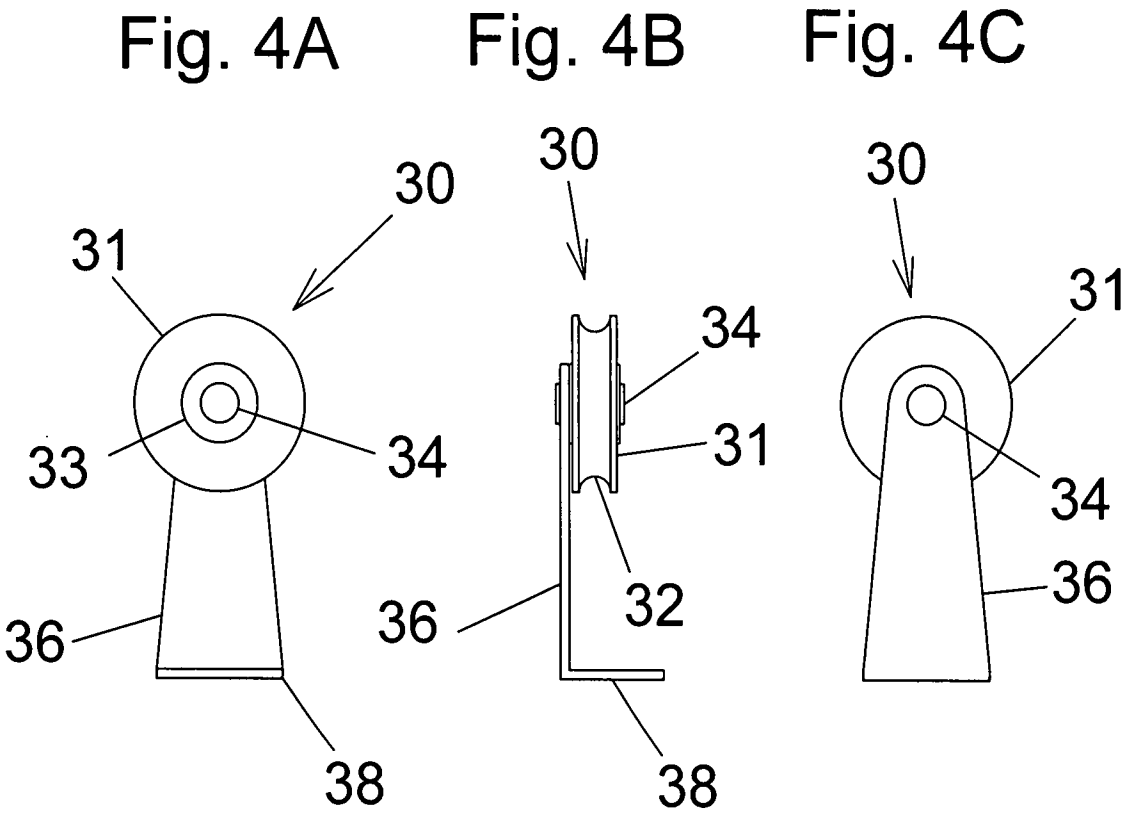
FIGS. 4A, 4B and 4C are the back, side and front views of the assembled components that comprise a door carrier.

With reference to FIGS. 4A, 4B and 4C, the back, side and front views, respectively, are shown of the door carrier (30). Door carrier (30) comprises a door carrier frame (36) that has a door carrier base (38) on the bottom containing holes (not shown here) to allow for it to be secured to the top edge of the door (10) (not shown here) using suitable fasteners. The top end of the door carrier frame (36) has a roller wheel (31) mounted to it. Roller wheel (31) has a concave wheel edge profile (32) that is shaped to match the convex shape of the shaped suspension rail (40) (not shown here) so that it will fit onto the rail securely. Roller wheel (31) is fitted with a roller bearing (33) to allow for ease of rotation and a wheel fastener (34) that passes through the center of the roller bearing (33) and secures the roller wheel (31) to the door carrier frame (36). In place of roller bearing (33), another style of bearing, a bushing or just a hole through the roller wheel that would allow for the wheel to rotate could be used.

Figure 5B:
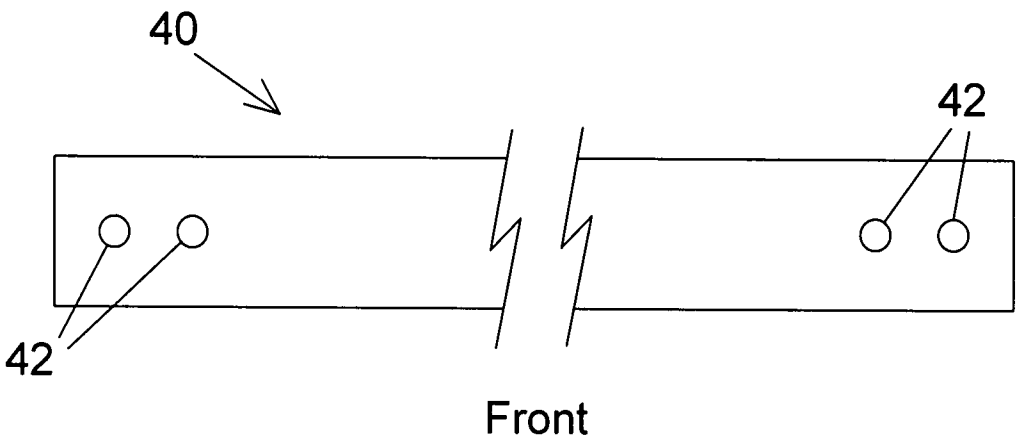
FIGS. 5A and 5B are the end and front views of the shaped suspension rail.
Figure 5A:
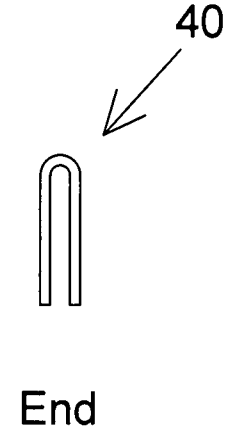

With reference to FIGS. 5A and 5B, the end and front views, respectively, of shaped suspension rail (40) are shown. Shaped rail (40) has an upside down U-shape profile that matches the concave wheel edge profile (32) (not shown here) of the roller wheel (31) (not shown here) on the door carrier (30) (not shown here). In practice, the profile of the shaped rail (40) and the mating profile of the edge of the roller wheel (not shown here) could be V-shaped, M-shaped, T-shaped, H-shaped or any other suitable interconnective profiles. A pair of shaped rail attachment holes (42) are located at each end of shaped suspension rail (40) to allow for the shaped rail to be secured at one end to the primary rail carrier (60) and at the other end to either type of the secondary rail carriers (70 or 93) (not shown here). The length of the shaped rail (40) will typically be slightly more (e.g., by 1 to 6 inches) than twice the width of the door opening so that when the door (10) is installed and in the full open position the edge of the door (10) is past the edge of the door opening (11) so there is no reduction in the usable width of the door opening (11).

Figure 6C:
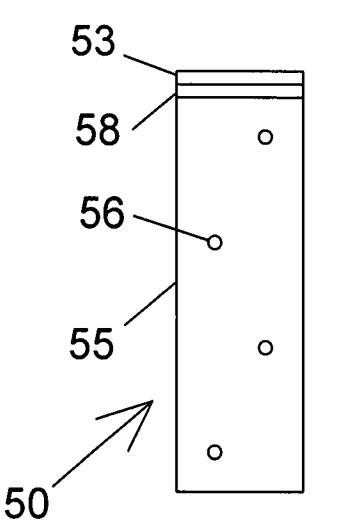
FIGS. 6A, 6B and 6C are the top, front and side views of the door frame mount.
Figure 6B:
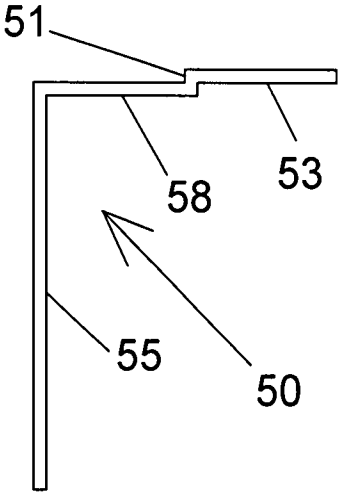
Figure 6A:
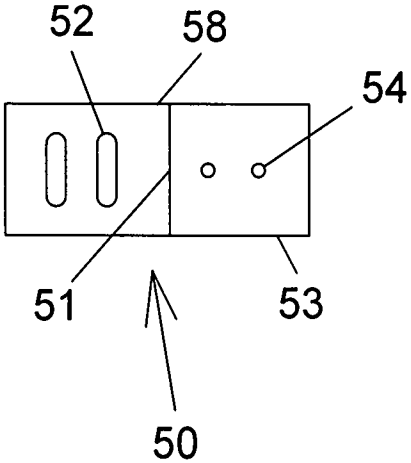

FIGS. 6A, 6B and 6C show the top, front and side views, respectively, of the door frame mount (50). The door frame mount (50) has a stepped bend (51) in the horizontal section (53) to create a carrier attachment location (58). The carrier attachment location (58) is fitted with a pair of slotted holes (52) that allow for the primary rail carrier (60) (not shown here) to be attached and adjusted in position. The horizontal section (53) is also fitted with a pair of header attachment holes (54) that allow for the door frame mount (50) to be secured to the face (14A) of the door frame header (14) (not shown here) using fasteners. The vertical section (55) of the door frame mount (50) has a set of leg attachment holes (56) that allow the door frame mount (50) to be secured to the face (12A) of the door frame leg (12) (not shown here) using fasteners.

Figure 7A:
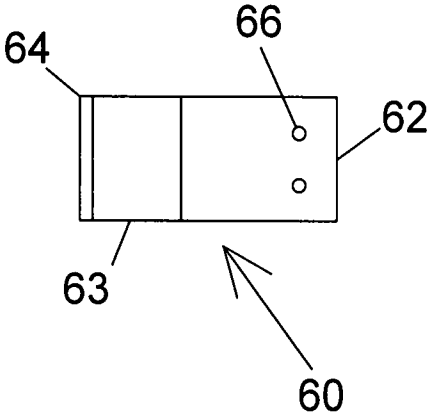
FIGS. 7A, 7B and 7C are the top, front and side views of the primary rail carrier.
Figure 7B:
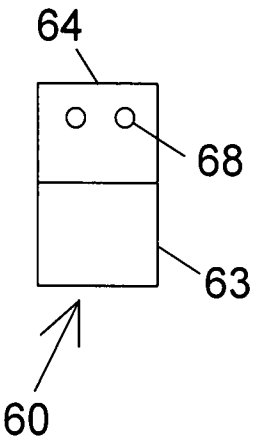
Figure 7C:
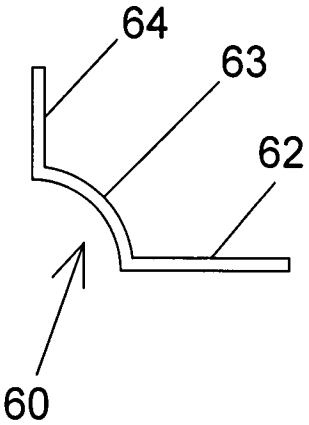

FIGS. 7A, 7B and 7C show the top, front and side views, respectively, of the primary rail carrier (60). The primary rail carrier (60) includes a horizontal primary rail carrier base (62), a vertical primary rail carrier upright (64), and a section between them, a clearance bend (63), which is shaped to allow the top of the door (10) and door carriers (30) (not shown here) to clear the primary rail carriers (60). The primary rail carrier upright (64) has two rail attachment holes (68) that will align with the attachment holes (42) in the end of the shaped suspension rail (40) (not shown here) so that it can be secured using fasteners. The primary rail carrier base (62) has two threaded base holes (66) that align with the slotted holes (52) in the door frame mount (50) (not shown here) so that it can be inserted into and secured to the door frame mount (50) (not shown) with threaded fasteners.

Figure 8A:
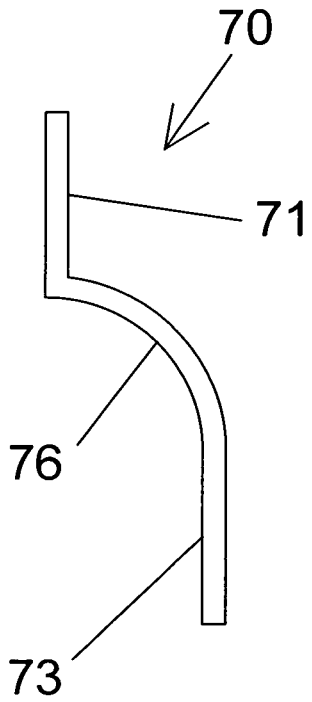
FIGS. 8A and 8B are the side and front views of the wall mounted secondary rail carrier.
Figure 8B:
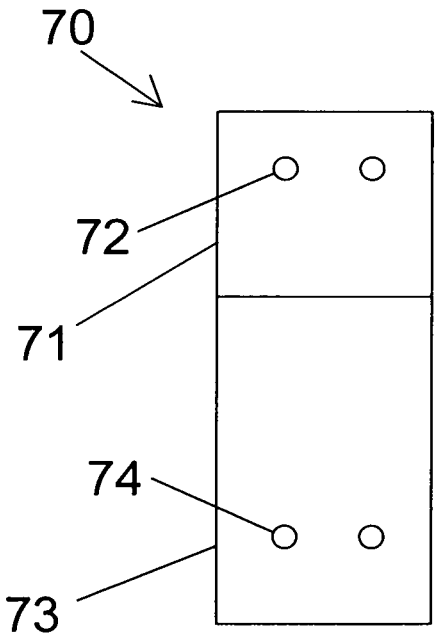

FIGS. 8A and 8B show the side and front views of the secondary rail carrier (70). The secondary rail carrier (70) has an upper vertical section (71) with two rail attachment holes (72) that will align with the attachment holes (42) in the end of the shaped rail (40) (not shown) so that it can be secured using threaded fasteners. There is also a lower vertical section (73) containing wall attachment holes (74) which allow for the secondary rail support to be secured to the wall (9) with fasteners. The two vertical sections are connected by a clearance bend section (76) that is shaped to allow the top of the door (10) and door carriers (30) (not shown here) to clear the secondary rail carrier (70). The shape of the secondary rail carrier (70) is such that the face of the lower vertical section (73) will be against the wall (9) when the primary rail carriers (60) (not shown here) are fully seated into the door frame mounts (50) (not shown). If the primary rail carriers (60) (not shown here) are adjusted to move the shaped suspension rail (40) (not shown here) away from the wall (9), then a spacer made from wood, plywood or other suitable material of the correct thickness (not shown) needs to be placed between the secondary rail carrier (70) and the wall (9) prior to fastening it to the wall (9).

Figure 9A:
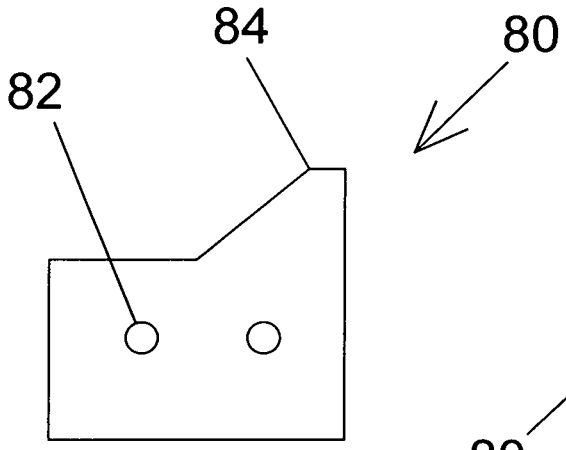
FIGS. 9A and 9B are the front and side views of the end stop.
Figure 9B:
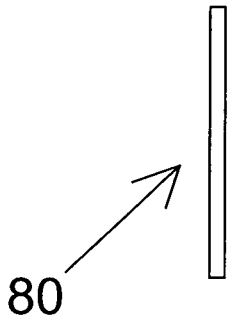
Figures 10A, 10B, 10C, 10D:
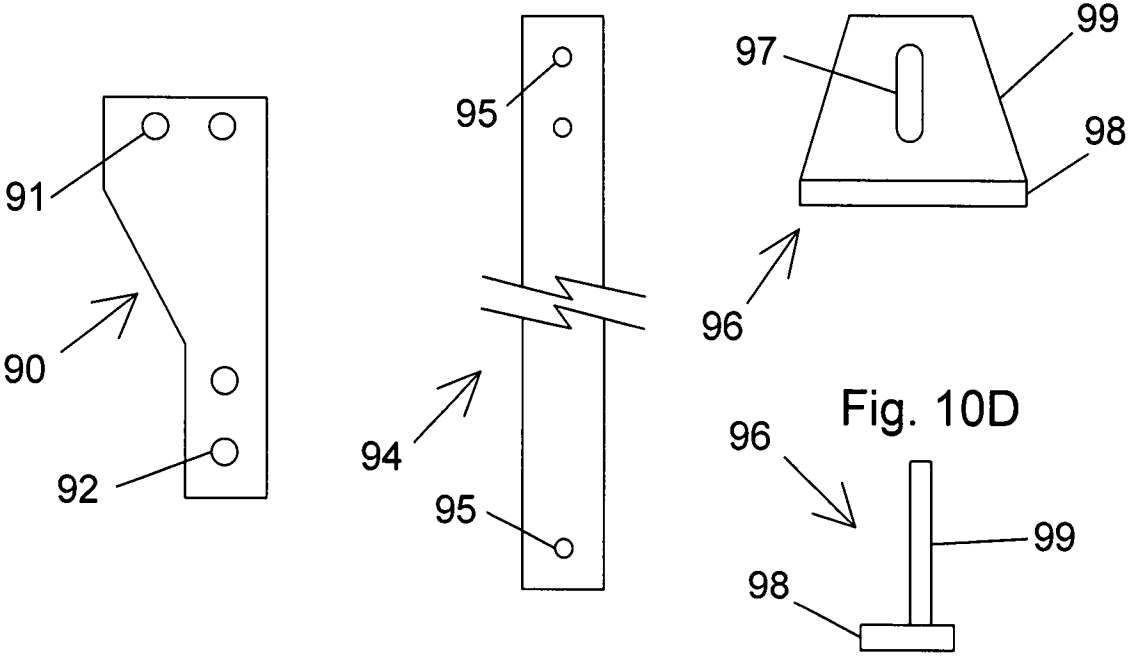
FIGS. 10A, 10B, 10C and 10D are the secondary rail carrier attachment, support rod, and the front and side views of the support foot. These three parts combine to form the floor supported secondary rail carrier.

FIGS. 9A and 9B show the front and side views, respectively, of the end stop (80). End stop (80) has a pair of rail attachment holes (82) that will align with the attachment holes (42) in the ends of the shaped suspension rail (40) (not shown here) so that it can be secured using fasteners to both the shaped rail (40) (not shown here) and to either the secondary rail carrier (70) (not shown here) or the primary rail carrier (60) (not shown here) that the other end of the shaped rail (40) (not shown here) is attached to. The end stop (80) has a raised edge with a shape and height effective to form the wheel stop (84). The shape and height of the wheel stop (84) is such that the travel of the roller wheel (31) (not shown here) past the end of the shaped rail (40) (not shown here) is prevented.

FIGS. 10A, 10B, 10C and 10D show the front view of the secondary rail support attachment (90), the front view of the support rod (94) and the front and side views of the support foot (96), respectively. For installations that prevent the use of the previously described secondary rail carrier (70) (not shown here) due to the wall material or other reason, the secondary rail support attachment (90) is attached by inserting into the end of the shaped rail (40) (not shown here), aligning the rail attachment holes (91) with the holes (42) in the end of the shaped rail (40) (not shown) and securing with threaded fasteners. The bottom end of the secondary rail support attachment (90) has a pair of rod attachment holes (92) which are aligned with the two threaded support rod attachment holes (95) at the upper end of the support rod (94) and then threaded fasteners (not shown) are used to secure the secondary rail support attachment (90) to the support rod (94). The shape of the support rod (94) can be square, rectangular or a complex decorative shape and can be either solid or a hollow tube so long as it has sufficient strength to support the expected load. The support foot (96) has a flat support foot base (98) that is designed to rest on the floor and a vertical face (99). The support foot (96) has a support foot slotted hole (97) machined or stamped into the vertical face (99) that aligns with the single threaded support rod hole (95) in the lower end of the support rod (94) and a threaded fastener is used to secure the support foot (96) to the lower end of the support rod (94) after it has been adjusted to touch the floor surface. As discussed in the description of FIG. 2, these components are assembled to form the floor supported secondary rail carrier (93).

Figures 11A, 11B, 11C:
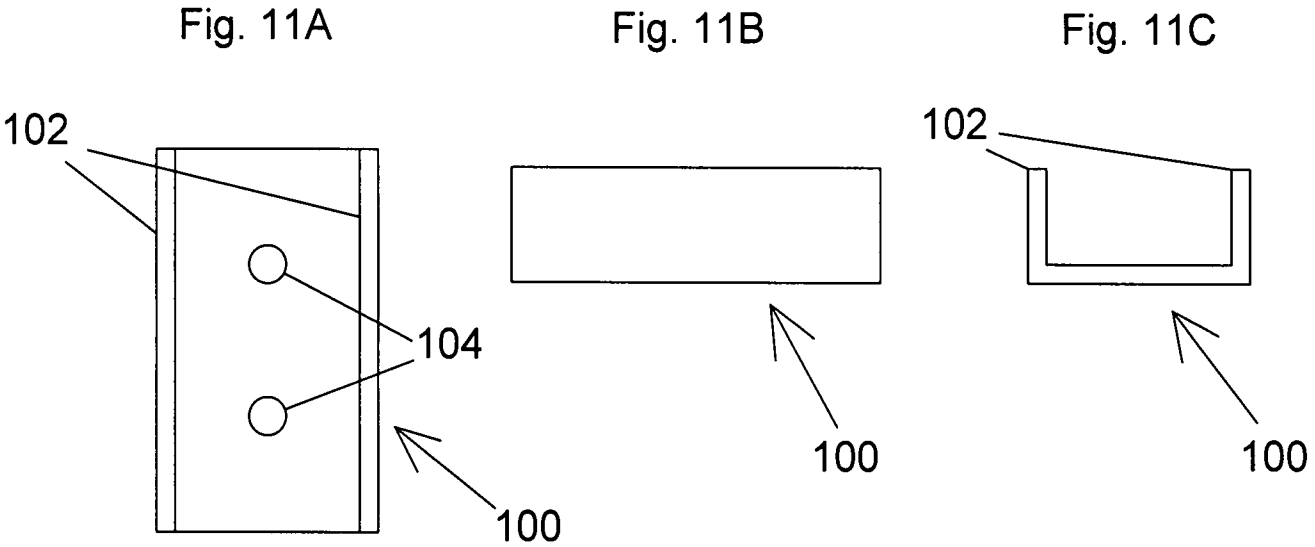
FIGS. 11A, 11B and 11C are the top, side and end views of the floor mounted door guide.

FIGS. 11A, 11B and 11C show the top, side and end views of the floor mounted door guide (100) respectively. The floor mounted door guide (100) has a rectangular U-shape with the two vertical guide edges (102) being tall enough to overlap the bottom edge of the door and with a gap between them that is slightly greater than the thickness of the existing interior door (typically 1⅜") so that the door can pass through the floor mounted door guide (100) without binding. The bottom of the floor mounted door guide (100) is fitted with two fastener holes (104) so that it can be mounted on the floor using nails or screws. The length of the floor mounted door guide (100) is such that it is long enough to overlap one edge of the door when it is fully open or closed but short enough to not serve as a trip hazard in the door opening.

In the foregoing description, certain terms have been used for brevity, clarity and understanding. All equivalent relationships to those illustrated in the drawings and described in the preferred embodiment are to be encompassed by this present invention to produce the intended results. It is also to be understood that the following claims are intended to cover all of the generic and specific features of the invention herein described, and all statements of the scope of the invention which, as a matter of language, might be said to fall therebetween.

Having thus described and disclosed preferred embodiment of my invention, what I claim as my invention is:

1. A kit for converting a conventional rectangular hinged door having a width, a length, a top edge and a bottom, said door being mountable in a rectangular door frame having two legs and a header defining a door opening having two upper corners in a wall connected to a floor to a sliding barn style door, comprising components to be interconnected to suspend the door parallel to said wall in a sliding position:

two door carriers, each having a roller wheel having a concave profile on the circumference thereof and adapted for attachment to the top edge of said door;

a shaped straight suspension rail having a top surface and a length greater than twice the width of said door and a convex profile on said top surface thereof designed to mate with the concave profile of said roller wheels of said door carriers;

two end stops adapted to be attached to each end of said shaped straight suspension rail to prevent said roller wheels of both said door carriers from traveling beyond either of the ends of the shaped rail;

two door frame mounts designed and adapted to be mounted inside the upper inner corners of said door frame to hold primary rail carriers, said door frame mounts having an L shape with a top horizontal portion comprising a stepped bend and slotted holes for attachment of said primary rail carriers;

suspension means to hold said rail and said door in place once the door is mounted on the rail; and primary rail carriers adapted to be mechanically attached to said door frame mounts to suspend said rail in place.

2. The kit of claim 1 wherein said suspension means comprise a secondary rail carrier comprising a shaped piece adapted to be mechanically attached to said wall behind the door and positioned to support said straight shaped suspension rail.

3. The kit of claim 1, further comprising sufficient mechanical fasteners to assemble all components into an operating sliding door system.

4. The kit of claim 1 wherein said rail carriers comprise brackets having vertical and horizontal sections separated by a curved section.

5. The kit of claim 1 wherein said primary rail carriers each comprise two vertical portions connected by a curved portion designed to provide an offset between said wall and the rail upon which said door is to be mounted.

6. The kit of claim 1 wherein said end stops comprise a raised portion adapted to prevent said roller wheels from passing beyond the designed area.

7. The kit of claim 1 wherein said suspension means comprise a vertical support system for said shaped suspension rail, comprising a shaped piece adapted to be attached to one end of said shaped straight suspension rail, a shaped base piece to be installed on the adjacent floor and a vertical support bar to be installed between said base piece and the shaped piece on the end of said shaped straight suspension rail to support that end of said shaped straight suspension rail.

8. The kit of claim 7 wherein said shaped base piece comprises a flat portion adapted to rest upon the floor and a face section perpendicular thereto adapted for fastening said base piece to said vertical support bar.

9. The kit of claim 7, wherein said shaped piece to be attached to said shaped straight suspension rail is fitted with attachment points for both said shaped straight suspension rail and said vertical support bar to connect them together with fasteners.

10. The kit of claim 1, further comprising a door guide having an upper open rectangular profile adapted to receive and guide the bottom of said door once attached to the floor adjacent the door frame.

11. A process of converting a conventional rectangular hinged door having top and bottom surfaces, sides and a width, mounted within a door frame having two legs and a header and upper corners, defining a doorway in a wall to a sliding barn door style door comprising steps of:

a) removing said door from its doorway, and also removing all hinges, related hardware and any lockset or door knobs;

b) mechanically attaching two door carriers comprising round roller wheels with concave profiles on the circumferences thereof to the top edge of said door;

c) mechanically attaching two door frame mounts having L shapes with top horizontal portions comprising a stepped bend and slotted holes for attachment of primary rail carriers in the upper corners of the door frame of said doorway;

d) inserting and mechanically attaching two primary rail carriers into the two door frame mounts;

e) mechanically attaching a single secondary rail carrier to the wall surface to one side of the doorway in a position designed to support one end of a shaped straight suspension rail having a convex upper profile;

f) installing said shaped straight suspension rail above said doorway, suspended by said primary and secondary rail carriers;

g) mechanically attaching two end stops to the ends of said shaped straight suspension rail, adapted to prevent the roller wheels of said door carriers from traveling beyond either end of the shaped rail;

h) placing the door in position and engaging the concave profiles of said roller wheels with the convex profile of said shaped straight suspension rail to slidably suspend the door in a position parallel to said wall surface; and I) adjusting the installed components as necessary to enable free sliding movement of the door from full open to full closed positions.

12. A process in accordance with claim 11 for installing a second embodiment with a vertical support system which comprises steps of:

a) in place of the secondary rail carriers of (e), attaching a secondary rail attachment to one end of said shaped straight suspension rail;

b) positioning a support foot on the floor below the same end of said shaped suspension rail; and c) installing a vertical support rod between said support foot and the secondary rail attachment attached to said shaped straight suspension rail to support said shaped straight suspension rail in place; and then, d) installing the door with door carriers in place onto said shaped straight suspension rail and adjusting the installed components as necessary to ensure proper operation.

13. A process in accordance with claim 11, wherein said hinged door is replaced with an oversized plain door without lockset or hinges and said oversized door is installed with a suspension rail, rail carriers and other components as recited therein.

14. A kit for converting a conventional rectangular hinged door having sides, a width, top and bottom surfaces, said door mountable within a rectangular door frame in a wall, said frame having two legs and a header plus upper corners, defining a doorway, to a sliding barn style door, comprising components to be interconnected to suspend the door in a sliding position parallel to said wall:

a) two door carriers, each having a circular roller wheel having a concave profile on the circumference thereof and adapted for attachment to the top edge of said door;

b) a shaped straight suspension rail having a length greater than twice the width of the door and a convex profile on the top surface thereof designed to mate with the concave profile of said roller wheels of said door carriers;

c) two end stops adapted to be attached to each end of said shaped straight suspension rail to prevent said roller wheels of said door carriers from traveling beyond either of the ends of said shaped straight suspension rail wherein said end stops comprise a raised portion adapted to prevent said roller wheels from passing beyond the intended area;

d) two door frame mounts designed and adapted to be mounted inside the upper inner corners of said door frame to hold primary rail carriers, wherein said door frame mounts are L-shaped brackets with a vertical section and a horizontal top section containing a stepped bend and slotted holes to create a carrier attachment location;

e) suspension means to hold said rail and said door in place when the door is mounted on said rail, comprising a secondary rail carrier comprising a single shaped piece adapted to be mechanically attached to said wall behind said door and positioned to support said shaped straight suspension rail, wherein said secondary rail carrier comprises two vertical portions connected by a curved portion designed to provide an offset between said wall and the rail upon which said door is to be mounted, and (f) in primary rail carriers adapted to be mechanically attached to said door frame mounts to suspend said rail in place, wherein said rail carriers comprise brackets having vertical and horizontal sections separated by a curved section.

* * * * *